United States Patent [19]

Ohtsuka

[11] 4,061,229

[45] Dec. 6, 1977

[54] DISPLAY DEVICE FOR BICYCLE BRAKE SHOES

[75] Inventor: Norio Ohtsuka, Ayase, Japan

[73] Assignee: Bridgestone Cycle Industry Co., Ltd., Tokyo, Japan

[21] Appl. No.: 662,731

[22] Filed: Mar. 1, 1976

[30] Foreign Application Priority Data

Jan. 7, 1976 Japan ..... 51-506

[51] Int. Cl.[2] ..... B65D 85/68; B65D 73/00

[52] U.S. Cl. ..... 206/486; 206/335; 206/459; 206/488

[58] Field of Search ..... 206/486, 487, 488, 489, 206/490, 459, 457, 373, 335; 188/24, 73.1

[56] References Cited

U.S. PATENT DOCUMENTS

| | | | |
|---|---|---|---|
| 1,734,032 | 11/1929 | Evans | 206/486 |
| 2,105,313 | 1/1938 | Cunningham | 206/335 |
| 2,778,492 | 1/1957 | Raeburn | 206/488 |
| 3,749,233 | 7/1973 | McCormick, Jr. | 206/373 |
| 3,840,093 | 10/1974 | Hamayasu | 188/24 |

*Primary Examiner*—William T. Dixson, Jr.
*Attorney, Agent, or Firm*—Silverman & Cass, Ltd.

[57] ABSTRACT

A display device for bicycle brake shoes which can advertise and sell the brake shoes is disclosed. The display device is formed of a plate-shaped body provided at its upper portion with a hanger hole and below the hanger hole with at least one longitudinal groove, the longitudinal groove being formed at its top end with an enlarged opening. The width of the longitudinal groove is slightly larger than a diameter of a mounting screw of the brake shoe and smaller than an outer diameter of washer and nut engaged with the mounting screw. The enlarged opening is slightly larger than the outer diameter of the washer and nut.

1 Claim, 7 Drawing Figures

DISPLAY DEVICE FOR BICYCLE BRAKE SHOES

This invention relates to a display device for bicycle brake shoes, which is designed to be hung on the wall and the like of shops for the purpose of advertising and selling the bicycle brake shoes.

An object of the invention is to provide a display device for bicycle brake shoes, which can advertise and sell the brake shoes, is very cheap, can detachably mount the brake shoes thereon in a simple and easy manner and takes up the least space.

The invention will now be described in greater detail with reference to the accompanying drawings, wherein.

Figure 4:
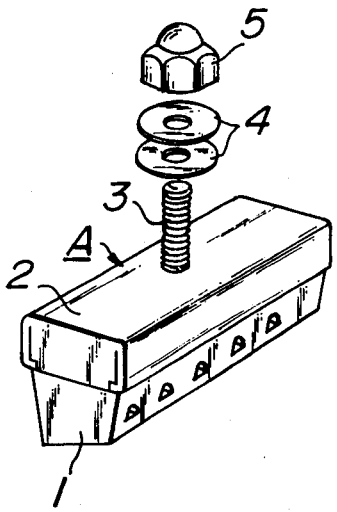
FIG. 4 is an exploded perspective view of a bicycle brake shoe.
Figure 5:
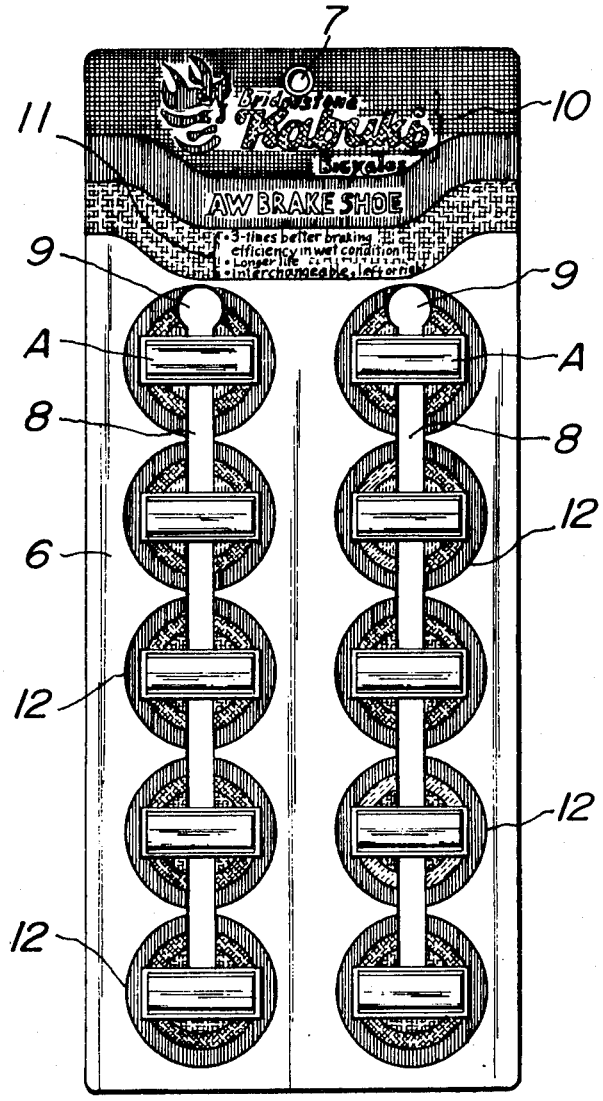
FIG. 5 is a front elevational view showing the display device according to the invention with brake shoes mounted thereon.
Figure 6:
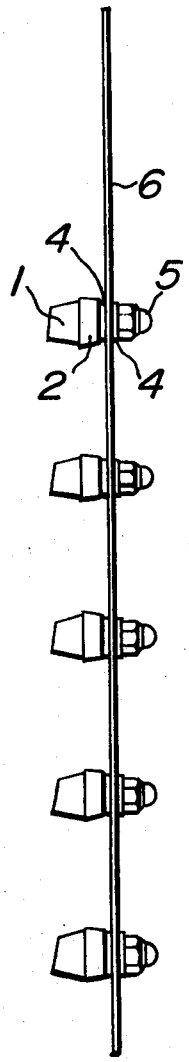
FIG. 6 is its side elevational view.
Figure 7:
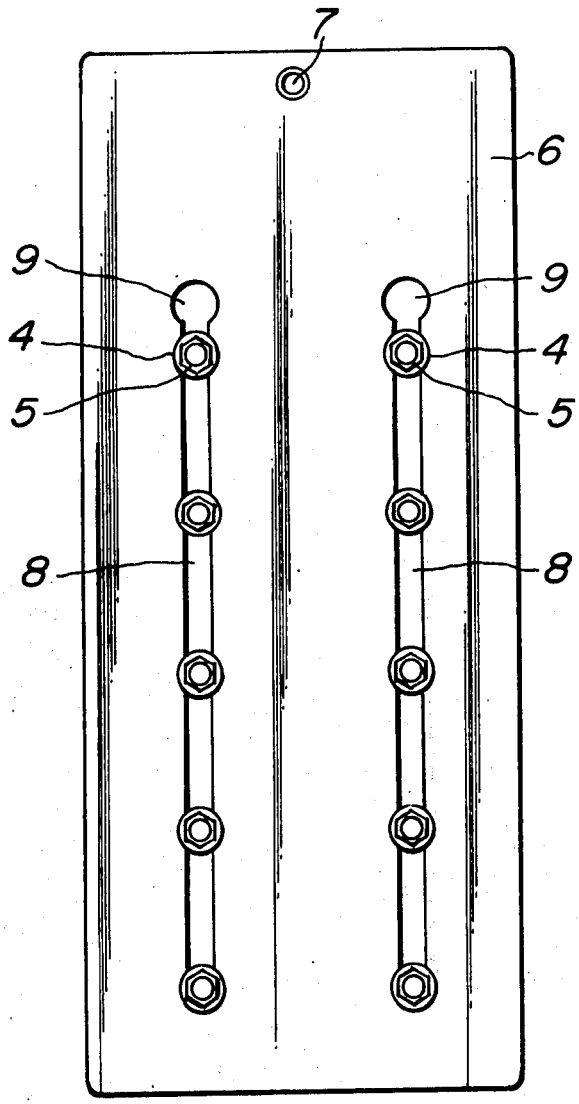
FIG. 7 is its rear view.

Referring now to the drawings and more specifically to FIGS. 4 and 5, A designates a bicycle brake shoe, which is merchandise to be advertised and sold. The brake shoe A is composed of a metal brake holder 2 provided at its one side with a brake rubber 1 and its opposite side with a mounting screw 3 with washers 4 and a nut 5 adapted to be engaged on said screw.

In accordance with the invention, use is made of an elongate plate-shaped body 6 formed of a cardboard, synthetic resin sheet or metal sheet and the like. The plate-shaped body 6 is provided at its upper portion with a hanger hole 7 by which the plate-shaped body 6 is hung on the wall of shops. The plate-shaped body 6 is also provided below the hanger hole 7 with two parallel longitudinal grooves 8 separated from each other and having a width which is slightly larger than a diameter of the mounting screw 3 and smaller than an outer diameter of the washer 4. The longitudinal groove 8 is formed at its top end with an enlarged opening 9 which is slightly larger than the outer diameter of the washer 4.

Figure 1:
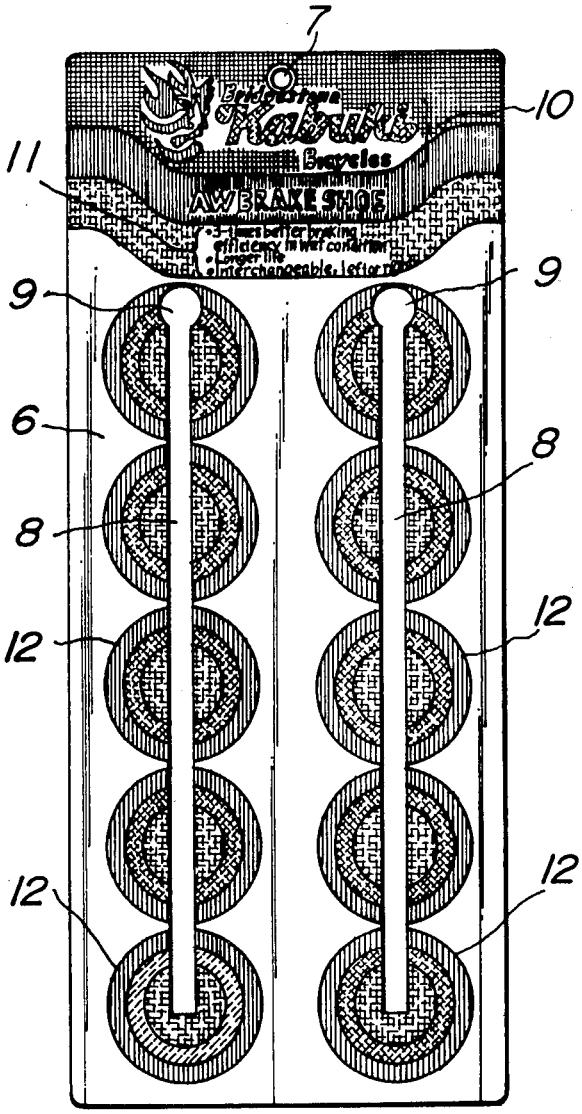
FIG. 1 is a front elevational view of the display device according to the invention.
Figure 2:
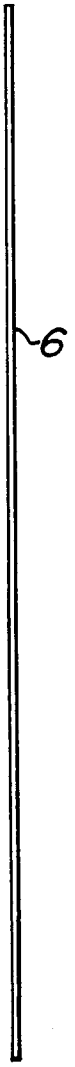
FIG. 2 is its side elevational view.
Figure 3:
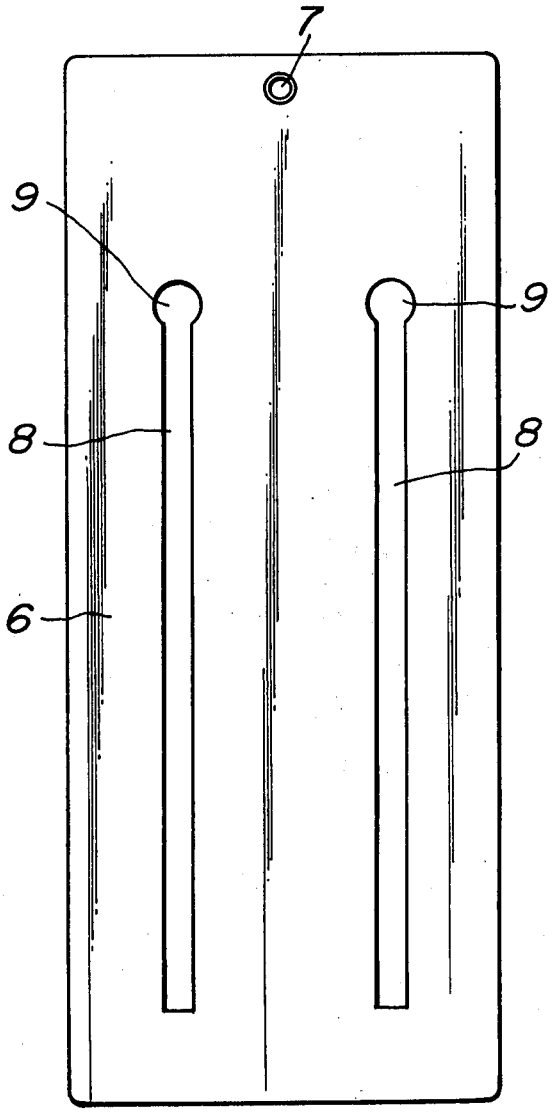
FIG. 3 is its rear view.

In FIGS. 1 and 5, reference numeral 10 designates a printed trademark and tradename, 11 printed advertising items printed above the longitudinal groove 8 and 12 printed colorful concentric marks printed along the longitudinal groove 8 and indicating location at which the brake shoe A is mounted on the plate-shaped body 6.

The display device constructed as described above according to the invention will be used in shops for selling the bicycle brake shoes.

The nut 5 and washers 4 engaged with the mounting screw 3 of the brake shoe A are inserted from the front side of the plate-shaped body 6 into the enlarged opening 9 so as to project these nut and washers rearwardly from the rear side of the plate-shaped body 6. Then, the mounting screw 3 with the nut 5 loosened is engaged with the longitudinal groove 8 and the brake shoe A is slidably moved along the the longitudinal groove 8 until it arrives at the lowest printed colorful mark 12 on the plate-shaped body 6 where the nut 5 is tightened up to secure the brake shoe A to the plate-shaped body 6. Another brake shoes A may be located on every successive printed colorful marks 12 on the plate-shaped body 6 and secured thereto.

It is a matter of course that the brake shoe A may detachably be located on the printed colorful mark 12 of the plate-shaped body 6 and secured thereto by successive operations of removing the nut 5 and washers 4 from the mounting screw 3, inserting the mounting screw 3 into the longitudinal groove 8 and fastening the nut 5 to the mounting screw 3. The use of such measure described, however, is troublesome in operation and provides the disadvantage that there is a risk of disassembled small parts of the brake shoe being missed during handling thereof. On the contrary, the invention is capable of avoiding these disadvantages by forming the enlarged opening 9 at the top end of the longitudinal groove 8.

The display device with the brake shoes A mounted thereon may be hung through the hanger hole 7 on the wall and the like of the shops. In this case, the printed colorful mark 12 causes the customers' eyes to be attracted to the brake shoes A. In addition, the customers can easily observe the printed trademark and tradename 10 as well as the printed advertising items 11. Thus, the display device according to the invention is extremely useful for advertising the brake shoes and is the key to self-service sales.

In the case of selling over the brake shoe A to the customer, the uppermost brake shoe A is released from the plate-shaped body 6 by loosening the nut 5 and then moving upwardly until it arrives at the enlarged opening 9. Then, the brake shoe A can simply and easily be extracted from the plate-shaped body 6 without requiring any troublesome operation of removing the nut 5 and washers 4 from the mounting screw 3 of the brake shoe A.

The display device according to the invention is composed of one plate-shaped body only, so that it may be hung on the wall and the like of shops together with a number of brake shoes A to be advertised and sold. In addition, the display device according to the invention takes up the least space and is very cheap in price since the plate-shaped body 6 may be formed of cardboard or synthetic resin sheet.

What is claimed is:

1. A display device for bicycle brake shoes, each of said shoes having a metal brake holder provided on one side with a brake rubber and on its opposite side with a single mounting screw with at least one washer and a nut engaged thereon, said display device comprising:

a longitudinally extending elongate plate-shaped body provided at its upper portion with a hanger hole and below said hanger hole with a plurality of vertically arranged longitudinal grooves;

each of said grooves having a width which is slightly larger than the diameter of said mounting screw and smaller than the outer diameter of said washer and said nut;

each said longitudinal groove being formed at its top end with an enlarged opening which is slightly larger than said outer diameter of said washer and nut whereby the assembled brake shoes may be placed on and removed from said device without removal of said nut and bolt;

said longitudinally extending elongate plate-shaped body being provided above said longitudinal grooves with a blank area adapted to receive advertising indicia, and along the length of said longitudinal grooves with vertically spaced printed marks, said brake shoes being secured to said device with said nuts tightened to hold the shoes in position over said printed marks vertically spaced from one another.

* * * * *